US007295177B2

(12) United States Patent
Shigeta et al.

(10) Patent No.: US 7,295,177 B2
(45) Date of Patent: Nov. 13, 2007

(54) DISPLAY PANEL DRIVING APPARATUS

(75) Inventors: Tetsuya Shigeta, Yamanashi-ken (JP); Tetsuro Nagakubo, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 661 days.

(21) Appl. No.: 10/775,118

(22) Filed: Feb. 11, 2004

(65) Prior Publication Data

US 2004/0160391 A1 Aug. 19, 2004

(30) Foreign Application Priority Data

Feb. 19, 2003 (JP) ..... P2003-040527

(51) Int. Cl.
*G09G 3/36* (2006.01)

(52) U.S. Cl. ..... 345/87; 345/55; 345/97; 345/99; 345/101; 345/208; 345/211; 345/214; 345/215

(58) Field of Classification Search ..... 345/87, 345/55, 97, 99, 101, 208, 211, 214–215
See application file for complete search history.

(56) References Cited

U.S. PATENT DOCUMENTS 5,329,275 A * 7/1994 Solomon ..... 340/825.22
5,784,037 A * 7/1998 Inoue ..... 345/87
6,323,829 B1 11/2001 Hosoi et al.
6,452,590 B1 * 9/2002 Awamoto et al. ..... 345/211

FOREIGN PATENT DOCUMENTS

EP 0 895 217 A1 2/1999
JP 11-052910 A 2/1999

* cited by examiner

*Primary Examiner*—Richard Hjerpe
*Assistant Examiner*—Leonid Shapiro
(74) *Attorney, Agent, or Firm*—Sughrue Mion, PLLC

(57) ABSTRACT

A display panel driving apparatus includes a display control section for controlling display on a plasma display panel, a drive section for driving the plasma display panel on the basis of a signal supplied from the display control section, and a transmission line for transferring data between the display control section and the drive section. The drive section includes a decoder section for decoding the signal supplied from the display control section and generating a control signal to generate drive pulses.

1 Claim, 10 Drawing Sheets

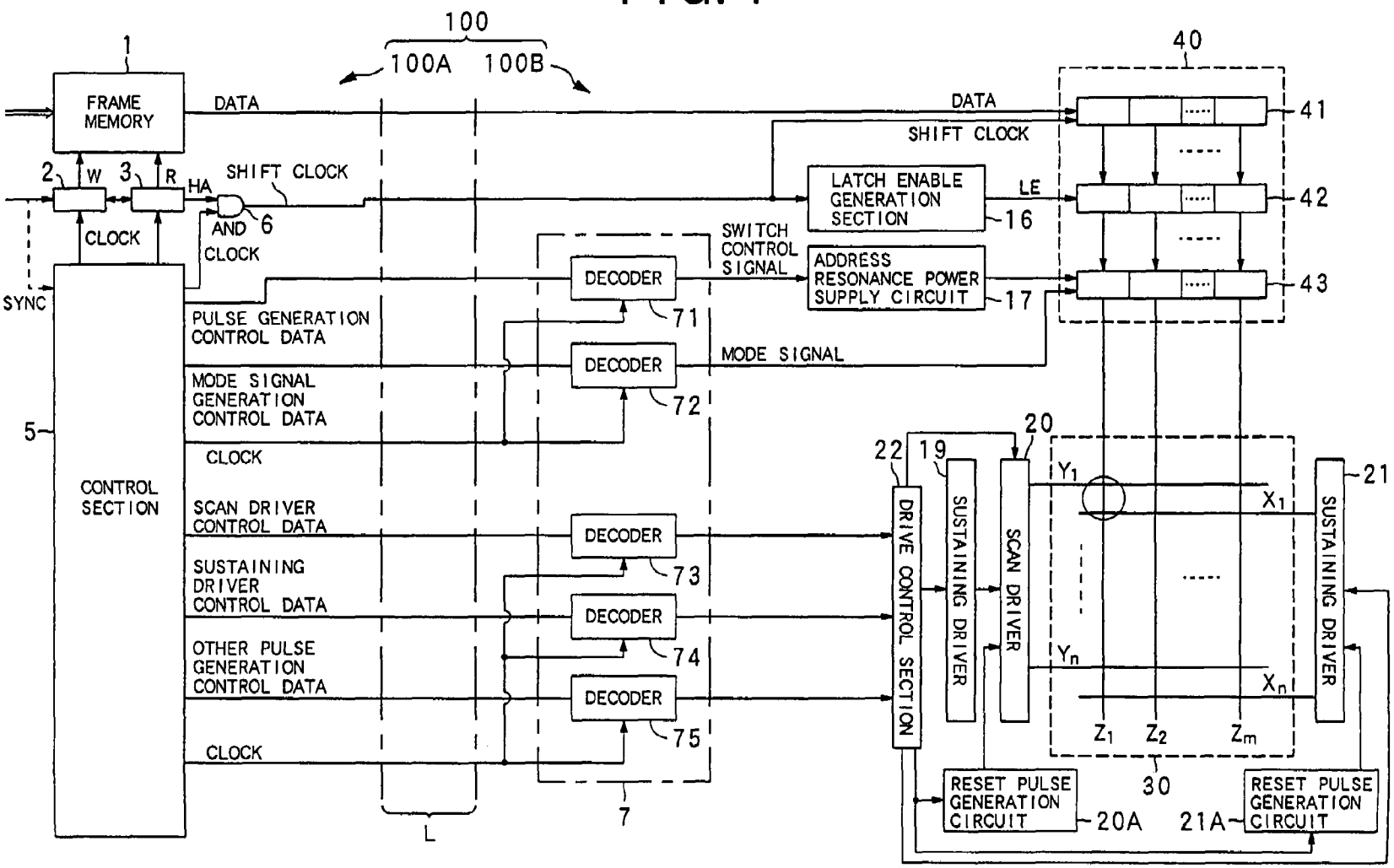
FIG. 1
FRAME MEMORY
DATA
SHIFT CLOCK
CLOCK
W
R
HA
AND
SYNC
CONTROL SECTION
PULSE GENERATION CONTROL DATA
MODE SIGNAL GENERATION CONTROL DATA
SCAN DRIVER CONTROL DATA
SUSTAINING DRIVER CONTROL DATA
OTHER PULSE GENERATION CONTROL DATA
SWITCH CONTROL SIGNAL
MODE SIGNAL
LE
LATCH ENABLE GENERATION SECTION
ADDRESS RESONANCE POWER SUPPLY CIRCUIT
DECODER
SUSTAINING DRIVER
SCAN DRIVER
DRIVE CONTROL SECTION
RESET PULSE GENERATION CIRCUIT
100
100A
100B
1
2
3
5
6
7
16
17
19
20
20A
21
21A
22
30
40
41
42
43
71
72
73
74
75
L

FIG.10A

| | OUTPUT | | |
|---|---|---|---|
| INPUT | SW1P | SW2P | SW3P |
| 00 | 0 | 0 | 0 |
| 01 | 1 | 0 | 0 |
| 10 | 1 | 0 | 1 |
| 11 | 0 | 1 | 0 |

FIG.10B

| | OUTPUT | | |
|---|---|---|---|
| INPUT | A | B | C |
| 00 | 1 | 1 | 0 |
| 01 | 0 | 0 | 1 |
| 10 | 0 | 0 | 0 |
| 11 | 0 | 1 | 0 |

FIG.10C

| | OUTPUT | | | |
|---|---|---|---|---|
| INPUT | SW1 | SW2 | SW3 | SW4 |
| 000 | 0 | 0 | 0 | 0 |
| 001 | 0 | 0 | 0 | 1 |
| 010 | 1 | 0 | 0 | 0 |
| 011 | 1 | 0 | 1 | 0 |
| 100 | 0 | 0 | 0 | 1 |

DISPLAY PANEL DRIVING APPARATUS

BACKGROUND OF THE INVENTION

1. Field of the Invention

The present invention relates to a display panel driving apparatus for display panel, such as plasma display panel, organic EL panel, field emission panel, etc.

2. Related Art

In U.S. Pat. No. 6,323,829 B1 (the disclosure of which is incorporated by reference in their entirety.), a display panel driving apparatus using a charge recovery type driving circuit is disclosed as a driving circuit for a plasma display panel. This charge recovery type driving circuit includes a plurality of switches. By turning on/off these switches at predetermined timing, predetermined pulses are generated (for example, see "Description of the Related Art" in U.S. Pat. No. 6,323,829 B1).

In the apparatus described in U.S. Pat. No. 6,323,829 B1, however, on/off control signals for the switches in the driving circuit are generated by a control section, and the control signals are supplied directly to a board for the driving circuit via a cable or the like. Therefore, the number of transmission lines becomes large, and there is a fear of occurrence of skew (timing deviation) on the transmission line. Furthermore, there is a fear that a control signal indicating an erroneous on/off state will be supplied to the driving circuit due to, for example, noise which comes from the outside and mixed with the signal on the transmission line.

SUMMARY OF THE INVENTION

The present invention has been achieved in order to solve the problems. An object of the present invention is to provide a display panel apparatus capable of reducing the number of transmission lines.

According to one aspect of the present invention, a display panel driving apparatus includes a display control section for controlling display on a display panel, a drive section for driving the display panel on the basis of a signal supplied from the display control section, and a data transfer device for transferring data between the display control section and the drive section, and the drive section includes a control signal conversion section for decoding signals supplied from the display control section and generating drive pulse generation control signals.

According to another aspect of the present invention, a display panel driving apparatus includes a display control section including a storage section for storing address data, a read section for reading address data stored in the storage section, and a shift clock generation section for generating a shift clock; a drive section including a shift register for sequentially storing the address data according to the shift clock, a latch enable generation section for generating a latch enable, and a driving circuit for driving a display panel with the address data stored in the shift register on the basis of the latch enable; and a data transfer device for transferring data between the display control section and the drive section, and the shift clock generation section generates the shift clock only during a period in which address data is being read from the storage section, and the latch enable generation section generates the latch enable on the basis of the shift clock.

BRIEF DESCRIPTION OF THE DRAWINGS

FIG. 1 is a block diagram showing a first embodiment of a display panel driving apparatus;

FIGS. 10A to 10C are diagrams showing look-up tables used for decoding, in which FIG. 10A is a diagram showing a look-up table used for decoding in a decoder 71, FIG. 10B is a diagram showing a look-up table used for decoding in a decoder 72, and FIG. 10C is a diagram showing a look-up table used for decoding in a decoder 74.

DESCRIPTION OF PREFERRED EMBODIMENTS

First Embodiment

Figure 2:
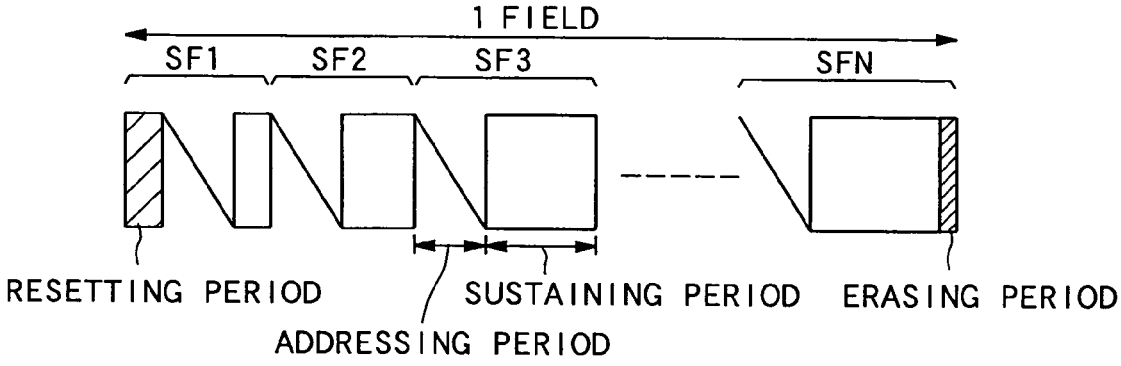
FIG. 2 is a diagram showing a configuration of one field.

Hereafter, a first embodiment of a display panel driving apparatus according to the present invention will be described with reference to FIGS. 1 to 10. FIG. 1 is a block diagram showing a display panel driving apparatus in the present embodiment.

As shown in FIG. 1, a display panel driving apparatus 100 of the present embodiment is formed by connecting a display control section 100A and a drive section 100B to each other via transmission lines L.

As shown in FIG. 1, the display control section 100A includes a frame memory 1 for storing address data sequentially, a write control section 2 for writing address data into the frame memory 1, a read control section 3 for reading address data from the frame memory 1, a control section 5 for controlling respective sections in the display control section 100A, and an AND circuit 6 for performing an AND on a clock output from the control section 5 and a signal HA output from the read control section 3.

The drive section 100B includes a decoder section 7 for decoding various control data transferred via the transmission lines L, an addressing driver section 40 including a shift register 41 for storing address data corresponding to one line, a latch circuit 42 for latching address data corresponding to one line when the address data corresponding to one line has been stored, and an addressing driver 43 for generating data pulses corresponding to one line to be generated in response to the address data corresponding to one line and applying the data pulses simultaneously to column electrodes Z1 to Zm of a plasma display panel 30, a latch enable generation section 16 for generating a latch enable on the basis of a shift clock, an address resonance power supply circuit 17 for outputting drive pulses toward the addressing driver 43, a sustaining driver 19 for simultaneously applying Y sustaining pulses to sustaining electrodes Y1 to Yn of the plasma display panel 30, a scan driver 20 for applying scan pulses sequentially to the sustaining electrodes Y1 to Yn, a sustaining driver 21 for simultaneously applying X sustaining pulses to sustaining electrodes X1 to Xn of the plasma display panel 30, a reset pulse generation circuit 20A and a reset pulse generation circuit 21A for generating a reset pulse, and a drive control section 22 for controlling the sustaining driver 19, the scan driver 20, the sustaining driver 21.

As shown in FIG. 1, the decoder section 7 includes a decoder 71, a decoder 72, a decoder 73, a decoder 74 and a decoder 75. To the decoders 71 to 75, pulse generation control data, mode signal generation control data, scan driver control data, sustaining driver control data, and other pulse generation control data, which are transferred from the control section 5 via the transmission lines L, are input, respectively.

A common clock output from the control section 5 and transferred via the transmission lines L is input to the decoder 71 and the decoder 72. Another common clock output from the control section 5 and transferred via the transmission lines L is input to the decoders 73 to 75.

As shown in FIG. 1, address data read out from the frame memory 1 and transferred via the transmission lines L is input to the shift register 41 in the addressing driver section 40. A shift clock output from the AND circuit 6 and transferred via the transmission lines L is input to the shift register 41 and the latch enable generation section 16.

As shown in FIG. 1, a switch control signal obtained by decoding the input data in the decoder 71 is input to the address resonance power supply circuit 17. A mode signal obtained by decoding the input data in the decoder 72 is input to the addressing driver 43. Data obtained by decoding the input data in the decoders 73 to 75 are input to the drive control section 22. The drive control section 22 controls generation timing of drive pulses on the basis of these data.

Next, operation of the display panel driving apparatus 100 will be described.

One field functioned as a period for driving the plasma display panel 30 includes a plurality of subfields SF1 to SFN. As shown in FIG. 2, an addressing period for selecting a cell to be lit and a sustaining period for causing the cell selected in the addressing period to continue to be lit for a predetermined time are provided in each subfield. A reset period for resetting the lit state in a preceding field is further provided in a head portion of SF1, which is a first subfield. In this reset period, all cells are reset to lit cells (cells having wall charge formed therein) or reset to put-out cells (cells having no wall charge formed therein). In the former case, predetermined cells are switched to put-out cells in a subsequent addressing period. In the latter case, predetermined cells are switched to lit cells in the subsequent addressing period. In the order of SF1, SF2, . . . SFN, each sustaining period is prolonged step by step. Predetermined gradation display is realized by changing the number of subfields for which cells sustain the lighting.

Figure 3:
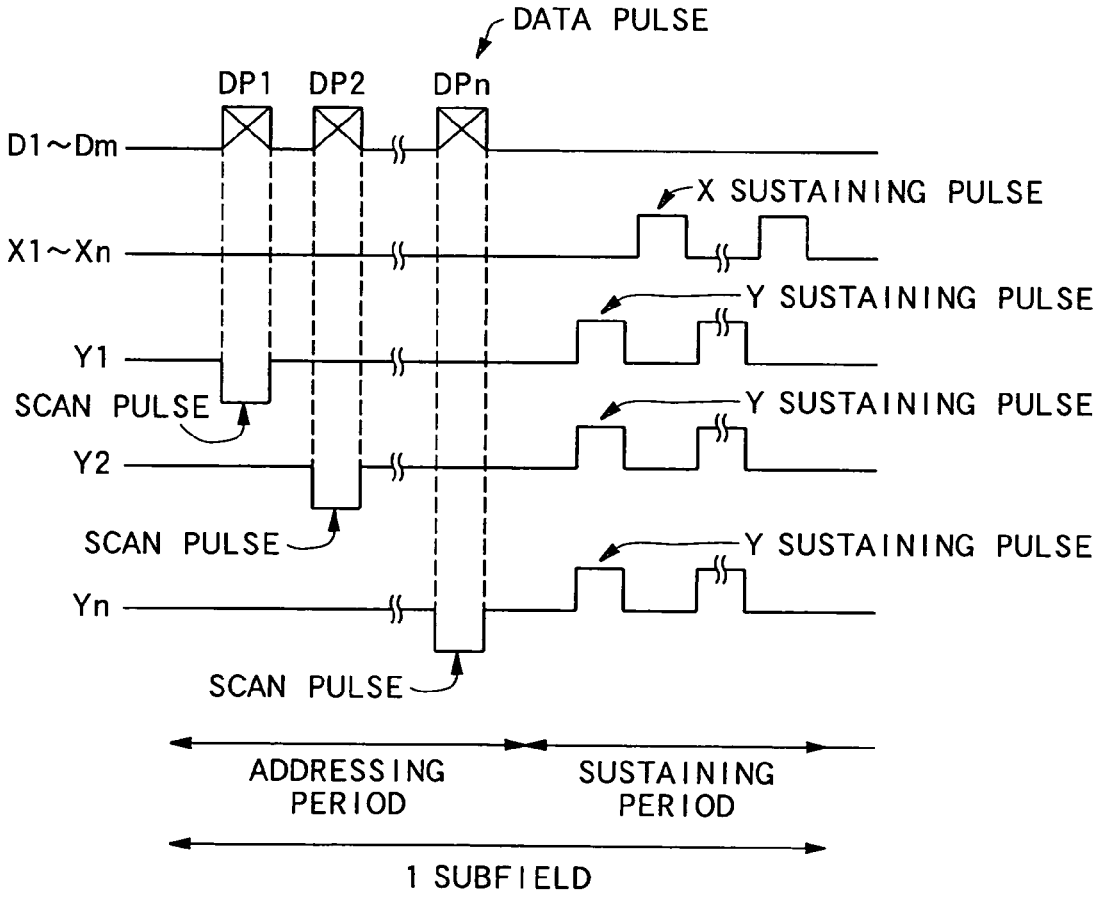
FIG. 3 is a diagram showing drive pulses in one subfield.

In the addressing period of each subfield shown in FIG. 3, the address scan is conducted from line to line. In other words, at the time that a scan pulse is applied to a row electrode Y1 forming a first line, a data pulse DP1 depending on address data that corresponds to cells on a first line is applied to column electrodes Z1 to Zm. Subsequently, at the time that a scan pulse is applied to a row electrode Y2 forming a second line, a data pulse DP2 depending on address data that corresponds to cells on a second line is applied to column electrodes Z1 to Zm. A scan pulse and a data pulse are simultaneously applied to cells on each of a third line and subsequent lines as well in the same way. Finally, at the time that a scan pulse is applied to a row electrode Yn forming an $n^{th}$ line, a data pulse DPn depending on address data that corresponds to cells on an $n^{th}$ line is applied to column electrodes Z1 to Zm. In the addressing period, predetermined cells are switched from lit cells to put-out cells, or from put-out cells to lit cells as described above.

When the address scan is thus completed, every cell in the subfield is set to either a lit cell or a put-out cell. In the subsequent sustaining period, only the lit cells repeat light emission every time a sustaining pulse is applied. In the sustaining period, an X sustaining pulse and a Y sustaining pulse are repetitively applied respectively to the row electrodes X1 to Xn and the row electrodes Y1 to Yn at predetermined timing as shown in FIG. 3. In the final subfield SFN, an erasing period for setting all cells to put-out cells is provided.

Signal processing for various control data and the clock used to drive the plasma display panel 30 will now be described.

As shown in FIG. 1, the address data read out from the frame memory 1 and the shift clock output from the AND circuit 6 are supplied to the shift register 41. Shift operation is executed on the address data in the shift register 41 on the basis of the shift clock. Here, the address data is bit data for each of R, G and B cells in each subfield.

On the other hand, the latch enable generation section 16 generates a latch enable on the basis of the shift clock output from the AND circuit 6, and outputs it toward the latch circuit 42.

Figure 4:
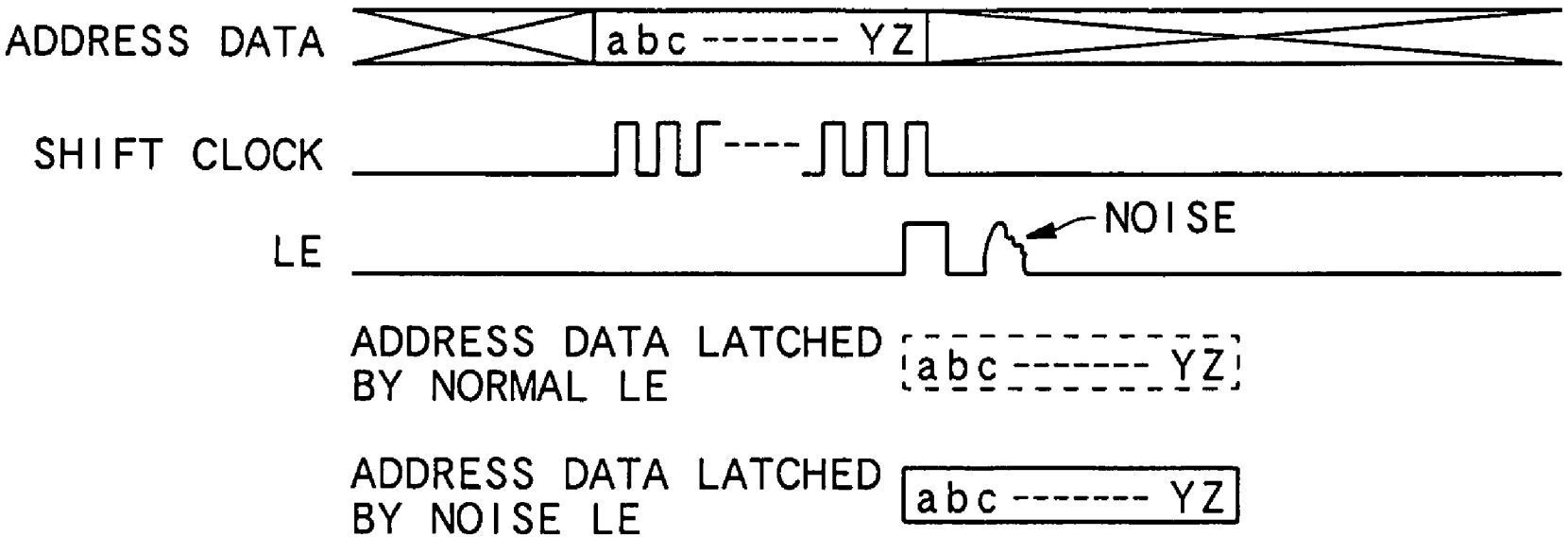
FIG. 4 is a diagram showing address data latched by latch enable.

FIG. 4 is a diagram showing the address data writing and latch enable timing. The address data read out from the frame memory 1 are sequentially written into the shift register 41 from line to line. As shown in FIG. 4, simultaneously with a rising edge of a shift clock for writing the final data (data z) corresponding to one line, a latch enable input to the latch circuit 42 rises. Therefore, the data corresponding to one line (for example, data "a" to data "z") are latched and simultaneously input to the addressing driver 43. As a result, at the time that a scan pulse is applied sequentially to the row electrodes Y1 to Yn, data pulses DP1 to DPn according to predetermined address data are applied to the column electrodes Z1 to Zm.

In the present embodiment, a signal HA is output from the read control section 3 only while the address data is being read out from the frame memory 1. Since the signal HA and the clock output from the control section 5 are input to the AND circuit 6, the clock is passed only during a period in which the signal HA is output (the signal HA is "H") and output as the shift clock, as shown in FIG. 1. Namely, during a period in which the address data is not read out from the frame memory 1, supply of the shift clock is stopped. Since the shift clock is not supplied during the period in which the address data is not read out as shown in FIG. 4, therefore, the data in the shift register 41 is not updated, and a storage state obtained when the signal of the normal latch enable has risen is maintained in the shift register 41. Even if noise is superposed on the latch enable, therefore, data latched by noise becomes the same as the normal address data as shown in FIG. 4. Even if address data is latched by noise at false timing, therefore, data pulses according to normal address data are applied to the plasma display panel 30.

The pulse generation control data output from the control section 5 is data for controlling on/off of a switching element provided in an address resonance power supply circuit 17 (FIG. 1), which outputs a drive pulse toward the addressing driver 43. A concrete example of the address resonance power supply circuit 17 will be described later.

On the other hand, the scan driver control data, the sustaining driver control data and other pulse generation control data, which are output from the control section 5, are input to the decoder 73, the decoder 74 and the decoder 75, respectively, as shown in FIG. 1. The decoders 73 to 75 decode respective control data on the basis of the clock supplied from the control section 5, and output decoded control data as the scan driver control data, the sustaining driver control data and other pulse generation control data, respectively.

Concrete processing of the decoding in the decoder section 7 will be further described later.

The drive control section 22 generates a signal for turning on/off switching elements provided in the scan driver 20 on the basis of the scan driver control data, generates a signal for turning on/off switching elements provided in the sustaining drivers 19 and 21 on the basis of the sustaining driver control data, and generates a signal for turning on/off switching elements that generate a reset pulse, an erase pulse, and so on, on the basis of other pulse generation control data.

A concrete example of the address resonance power supply circuit 17 and the addressing driver 43 will now be described with reference to FIGS. 5 and 6.

Figure 5:
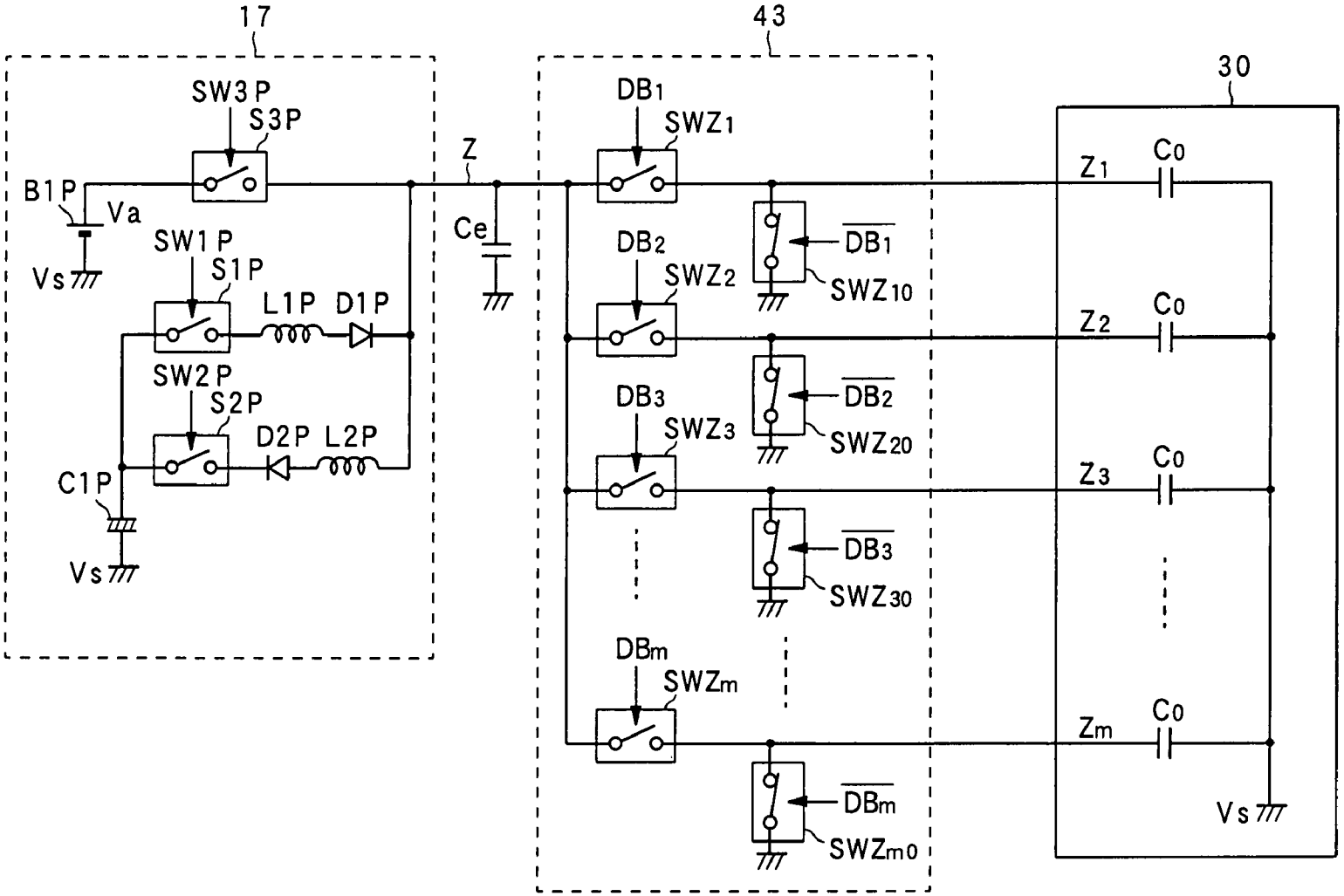
FIG. 5 is a diagram showing a configuration of an address resonance power supply circuit and an addressing driver.
Figure 6:
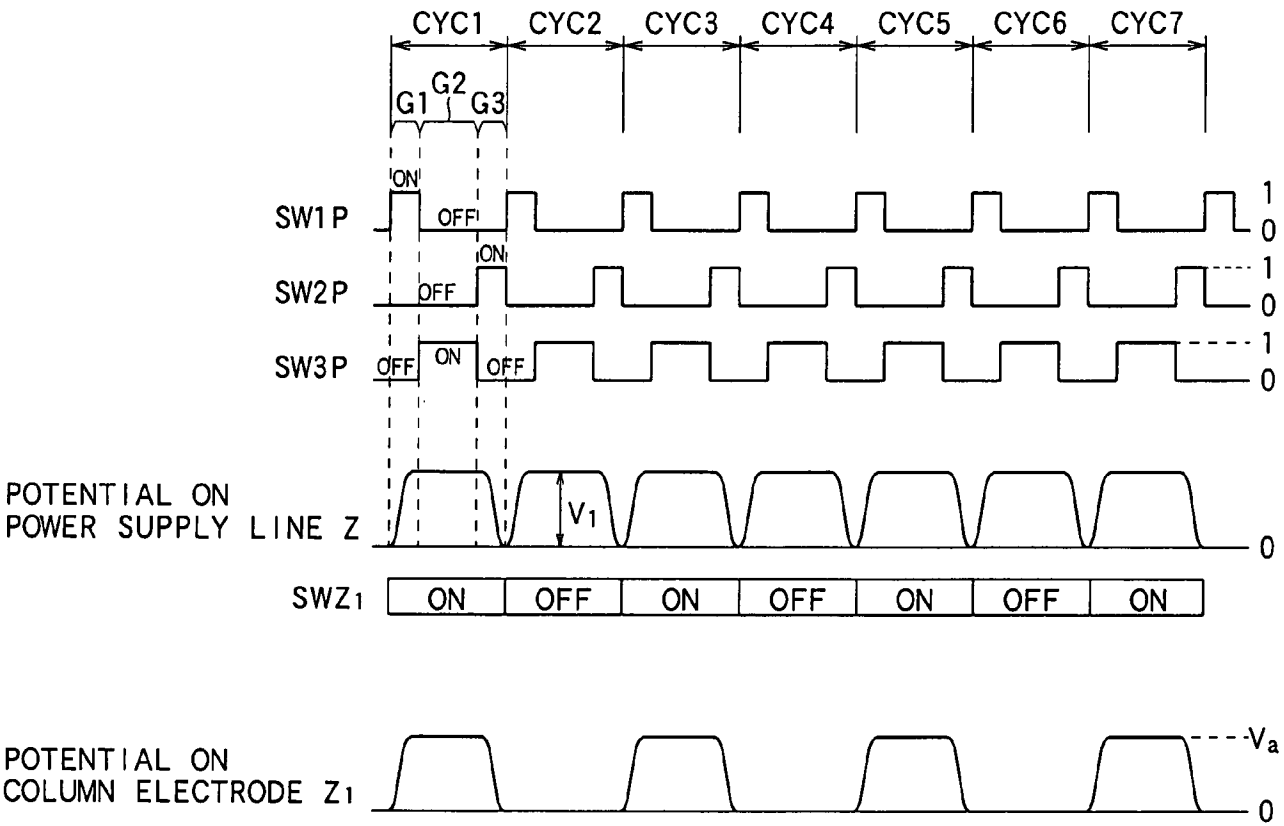
FIG. 6 is a diagram showing operation of an address resonance power supply circuit and an addressing driver in an addressing period.

The address resonance power supply circuit 17 shown in FIG. 5 generates a resonance pulse power supply potential having a predetermined amplitude, and outputs it to a power supply line Z shown in FIG. 5. A capacitor C1P in the address resonance power supply circuit 17 is connected at a first end thereof to a grounding potential Vs of the plasma display 30. When a switching element S1P is in the on-state, a potential generated at a second end of the capacitor C1P is applied to the power supply line Z via a coil L1P and a diode D1P. When a switching element S2P is in the on-state, the potential on the power supply line Z is applied to the second end of the capacitor C1P via a coil L2P and a diode D2P. At this time, the capacitor C1P is charged by the potential on the power supply line Z. When a switching element S3P is in the on-state, a power supply potential Va generated by a DC power supply B1P is applied onto the power supply line Z. A negative side terminal of the DC power supply B1P is connected to the grounding potential Vs for the plasma display panel 30.

As shown in FIG. 5, the addressing driver 43 includes switching elements SWZ1 to SWZm and SWZ10 to SWZm0, which are on/off-controlled independently according to pixel data bits DB1 to DBm corresponding to one row (m bits). Each of the switching elements SWZ1 to SWZm should be the on-state only when the pixel data bit DB supplied thereto is a logic level "1". The resonance pulse power supply potential applied to the power supply line Z is thus applied to the column electrodes Z1 to Zm in the plasma display panel 30. On the other hand, only when the pixel data bit DB is a logic level "0", each of the switching elements SWZ10 to SWZm0 should be the on-state, and makes the potential on the column electrode equal to the grounding potential Vs.

Hereafter, the operation conducted by the address resonance power supply circuit 17 and the addressing driver 43 in the addressing period will be described with reference to FIG. 6.

As shown in FIG. 5, the pulse generation control data SW1P to SW3P are input to the address resonance power supply circuit 17. The pulse generation control data SW1P to SW3P are data for turning on/off switching elements S1P to S3P, respectively. As shown in FIG. 6, switching elements repeat inversion so that the switching elements S1P, S3P and S2P may repetitively turn on in the cited order according to the pulse generation control data SW1P to SW3P. Such an operation periodically raises the potential on the power supply line Z. The periodic potential rising section coincides with the timing of scan conducted by the scan driver 20.

At this time, pixel data bits DB corresponding to predetermined column electrodes Z1 to Zm are input to the switching elements SWZ1 to SWZm and SWZ10 to SWZm0 in the addressing driver 43 according to timing of potential rising on the power supply line Z. FIG. 6 shows the case where a bit sequence of the pixel data bits DB corresponding to first to seventh rows in an $i^{th}$ column is [1, 0, 1, 0, 1, 0, 1]. The pixel data bits DB are nothing but address data latched by the latch circuit 42. In the addressing period, the operation heretofore described is executed sequentially for columns, and consequently cells can be set to lit cells/put-out cells for each of columns.

Figure 7:
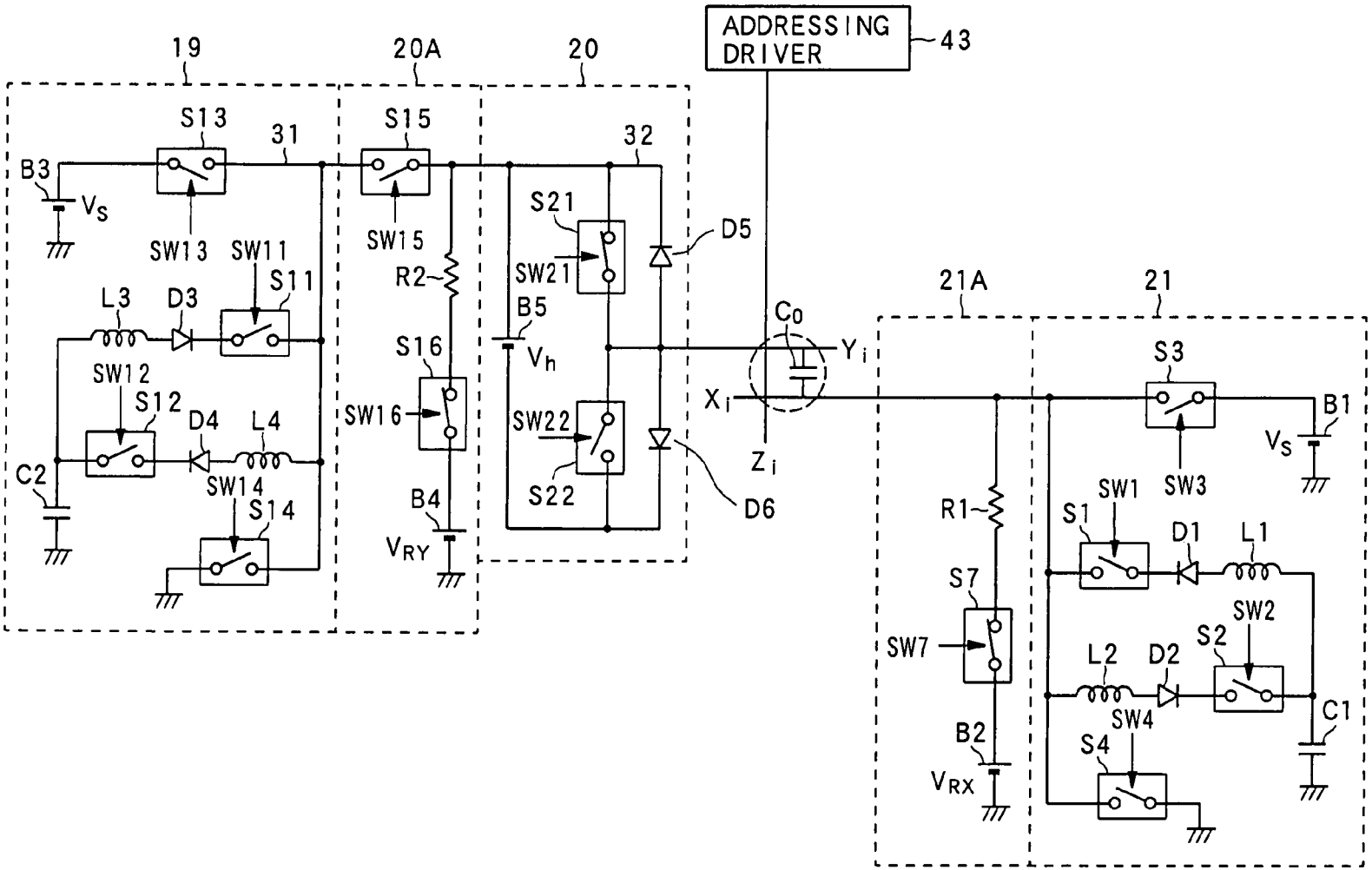
FIG. 7 is a diagram showing a configuration of a sustaining driver and a scan driver.

A concrete example of the sustaining drivers 19 and 21 and the scan driver 20 will now be described with reference to FIGS. 7 and 8.

The sustaining driver 21 includes a DC power supply B1 for generating a DC voltage VS, switching elements S1 to S4, coils L1 and L2, diodes D1 and D2, and a capacitor C1. When the switching element S1 is in the on-state, a potential on a first end of the capacitor C1 is applied to a row electrode Xi via the coil L1 and the diode D1. When the switching element S2 is in the on-state, the potential on the row electrode Xi is applied to the first end of the capacitor C1 via the coil L2 and the diode D2. When the switching element S3 is in the on-state, the voltage VS generated by the DC power supply B1 is applied to the row electrode Xi. When the switching element S4 is in the on-state, then the row electrode Xi is grounded.

The switching elements S1 to S4 in the sustaining driver 21 are controlled to turn on/off on the basis respectively of data SW1 to SW4 obtained by decoding the sustaining driver control data output from the control section 5 and transferred thereto.

The reset pulse generation circuit 21A includes a DC power supply B2 for generating a DC voltage VRx, a switching element S7, and a resistor R1. The positive side terminal of the DC power supply B2 is grounded, and the negative side terminal thereof is connected to the switching element S7. When the switching element S7 is in the on-state, a voltage −VR, which is the negative side terminal voltage of the DC power supply B2, is applied to the row electrode Xi via the resistor R1.

The switching element S7 in the reset pulse generation circuit 21A is controlled to turn on/off on the basis of data SW7 obtained by decoding the other pulse generation control data output from the control section 5 and transferred thereto.

The sustaining driver 19 includes a DC power supply B3 for generating a DC voltage VS, switching elements S11 to S14, coils L3 and L4, diodes D3 and D4, and a capacitor C2. When the switching element S11 is in the on-state, a potential on a first end of the capacitor C2 is applied onto a line 31 via the coil L3 and the diode D3. When the switching element S12 is in the on-state, then the potential on the line 31 is applied to the first end of the capacitor C2 via the coil L4 and the diode D4. When the switching element S13 is in the on-state, the voltage VS generated by the DC power supply B3 is applied to the line 31. When the switching element S14 is in the on-state, the line 31 is grounded.

The switching elements S11 to S14 in the sustaining driver 19 are controlled to turn on/off on the basis respectively of data SW11 to SW14 obtained by decoding the sustaining driver control data output from the control section 5 and transferred thereto.

The reset pulse generation circuit 20A includes a DC power supply B4 for generating a DC voltage VRy (where |VRy|<|VRx|), switching elements S15 and S16, and a resistor R2. The positive side terminal of the DC power supply B4 is grounded, and the negative side terminal thereof is connected to the switching element S16. When the switching element S16 is in the on-state, the voltage VRy, which is the positive side terminal voltage of the DC power supply B4, is applied onto a line 32. When the switching element S15 is in the on-state, the line 31 is connected to the line 32.

The switching elements S15 and S16 in the reset pulse generation circuit 20A are controlled to turn on/off on the basis respectively of data SW15 and SW16 obtained by decoding the other pulse generation control data output from the control section 5 and transferred thereto.

The scan driver 20 is provided for each of the row electrodes Y1 to Yn. The scan driver 20 includes a DC power supply B5 for generating a DC voltage Vh, switching elements S21 and S22, and diodes D5 and D6. When the switching element S21 is in the on-state, a positive side terminal of the DC power supply B5, the row electrode Yi, and a cathode end of the diode D6 are connected together. When the switching element S22 is in the on-state, then a negative side terminal of the DC power supply B5, the row electrode Yi, and an anode end of the diode D5 are connected together.

The switching elements S21 and S22 in the scan driver 20 are controlled to turn on/off on the basis respectively of data SW21 and SW22 obtained by decoding the scan pulse control data output from the control section 5 and transferred thereto.

Figure 8:
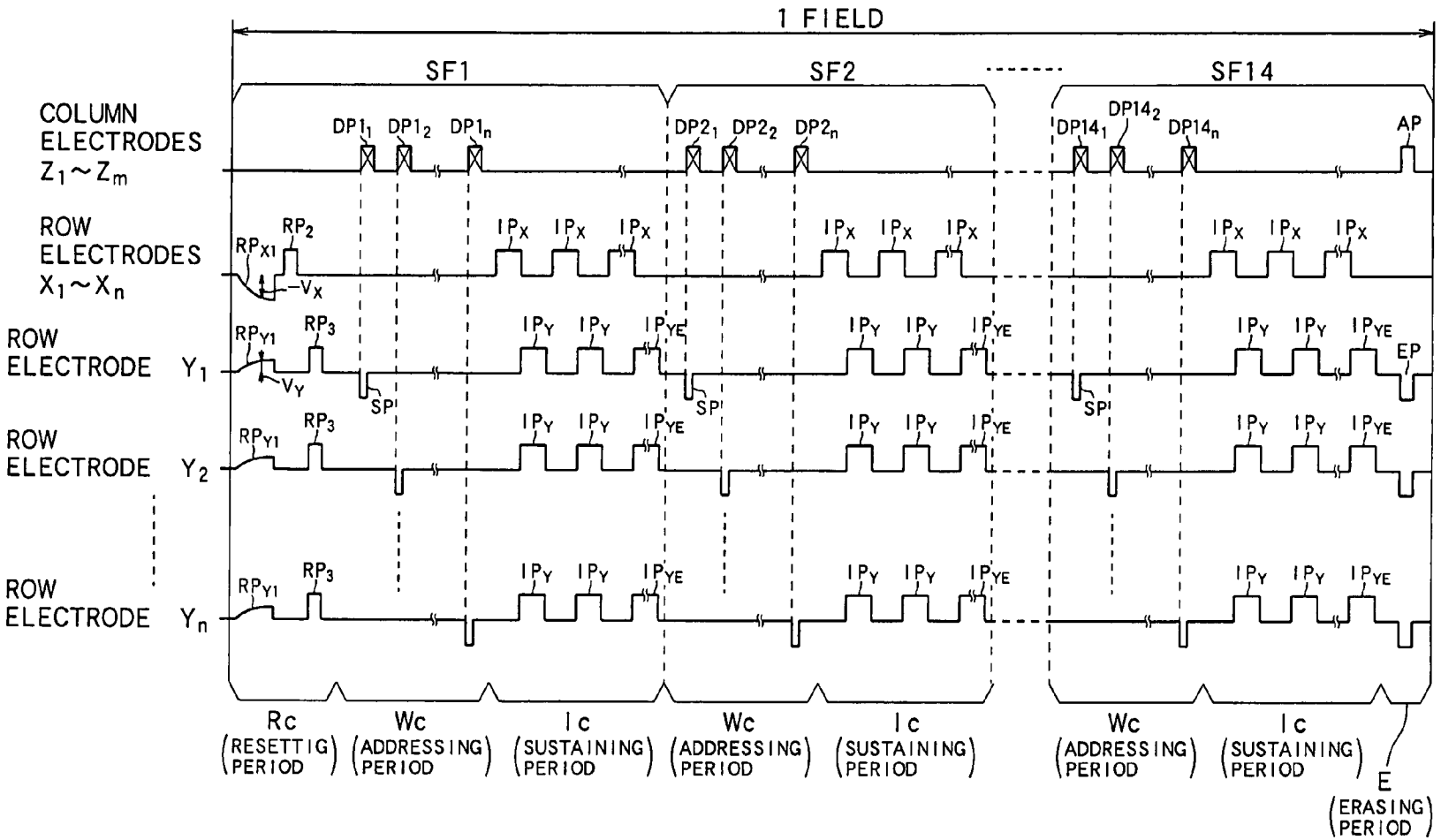
FIG. 8 is a diagram showing an example of application timing of various drive pulses applied to address electrodes and row electrodes.

FIG. 8 is a diagram showing an example of application timing of various drive pulses applied from the addressing driver 43, the sustaining drivers 19 and 21, the scan driver 20, and the reset pulse generation circuits 20A and 21A to the address electrodes Z1 to Zm, the row electrodes X1 to Xn and Y1 to Yn in the plasma display panel 30.

As shown in FIG. 8, the reset pulse generation circuits 21A and 20A apply reset pulses RPX1 and RPY1 simultaneously to the row electrodes X1 to Xn and Y1 to Yn in a reset period Rc. As a result, discharge is caused between row electrodes in every cell, and a uniform wall charge is formed in each cell. As a result, all cells are initialized to lit cells.

In an addressing period Wc, the addressing driver 43 applies a pixel data pulse group for each row sequentially to the column electrodes Z1 to Zm. The pixel data pulse group corresponds to the bit sequence of the pixel data bit DB. At this time, the scan driver 20 generates a scan pulse SP at the same timing as that of application of the pixel data pulse group, and applies the scan pulse SP sequentially to the row electrodes Y1 to Yn. At this time, only when the scan pulse SP is applied to one row electrode and the pixel data pulse of high voltage is applied to the address electrode, discharge (selective erased discharge) is caused in the cell between the row electrode and the address electrode and the wall charge remaining in the cell is erased, the cell being changed to a put-out cell. The wall discharge remains in other cells, and those cells remain to be lit cells. Thus, in the addressing period Wc, all cells are set to lit cells or put-out cells according to the address data.

In the sustaining period Ic, the sustaining drivers 21 and 19 alternately apply sustaining pulses IPX and IPY each having pulse amplitude Vs to the row electrodes X1 to Xn and Y1 to Yn. At this time, only lit cells having remaining wall charge repetitively emit light in the addressing period.

In a final subfield (a subfield SF14 in FIG. 8) in one field, an erasing period E is provided. In the erasing period E, the addressing driver 43 generates an erase pulse AP, and applies the erase pulse AP to the column electrodes Z1 to Zm. On the other hand, the scan driver 20 generates an erase pulse EP simultaneously with the erase pulse AP, and applies the erase pulse EP to each of the row electrodes Y1 to Yn. By simultaneous application of the erase pulses AP and EP, erase discharge occurs and the wall charge disappears, in every cell.

Figure 9:
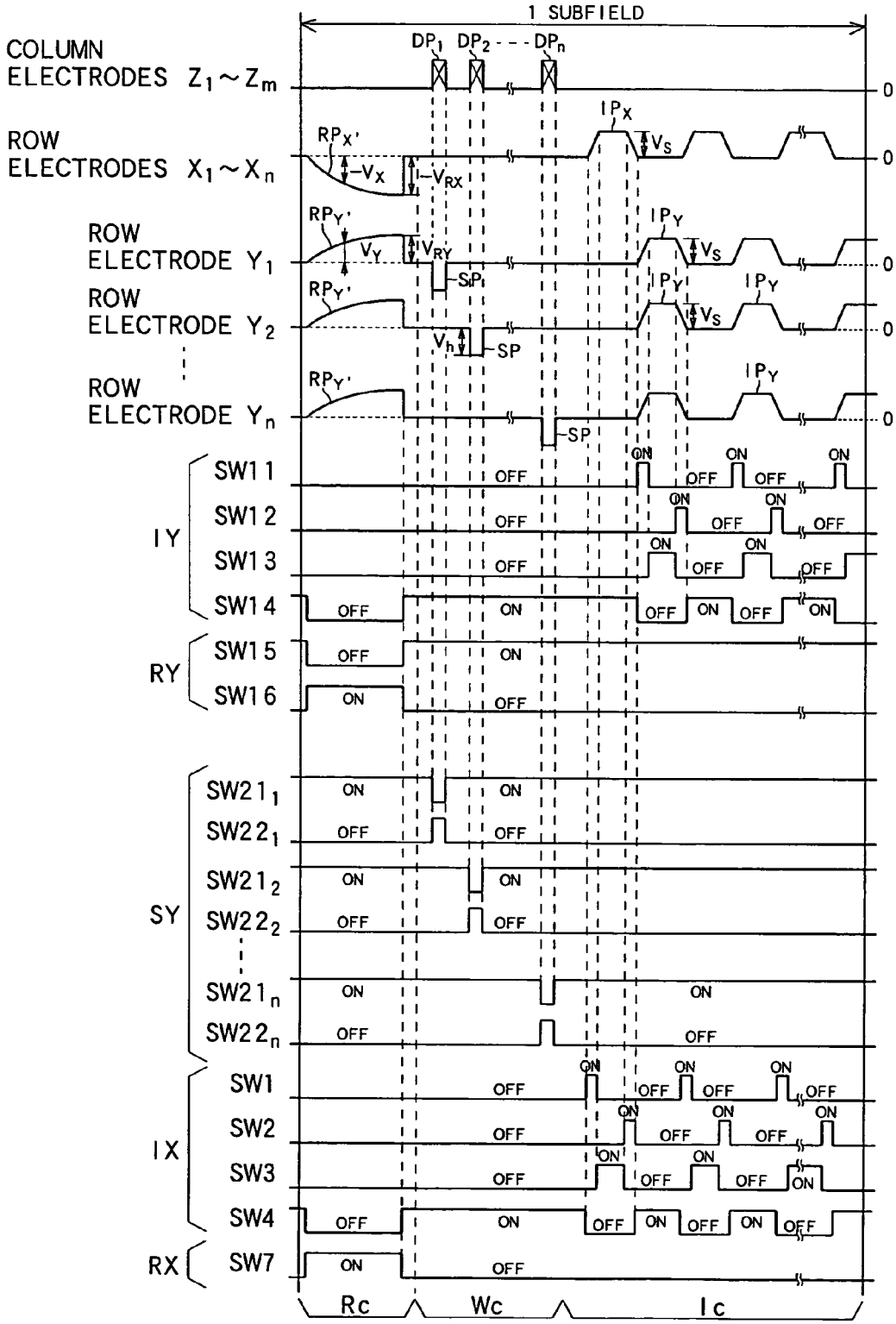
FIG. 9 is a diagram showing application timing of drive pulses and switching timing of switching elements in the case where a selective erasing method is adopted.

FIG. 9 is a diagram showing application timing of drive pulses applied from the addressing driver 43, the sustaining drivers 19 and 21, the scan driver 20, and the reset pulse generation circuits 20A and 21A to the plasma display panel 30, and switching timing of respective switch elements.

Detailed description of FIG. 9 will be omitted. By thus controlling a large number of switching elements provided in the addressing driver 43, the sustaining drivers 19 and 21, the scan driver 20, and the reset pulse generation circuits 20A and 21A, however, desired drive pulses can be applied to respective electrodes in the plasma display panel 30.

In the present embodiment, various control data output from the control section 5 are decoded in the decoder section 7 as described above. Each of the decoders in the decoder section 7 executes decoding by using a look-up table (LUT).

FIGS. 10A to 10C are diagrams showing look-up tables used for decoding, in which FIG. 10A is a diagram showing a look-up table used for decoding in the decoder 71, FIG. 10B is a diagram showing a look-up table used for decoding in the decoder 72, and FIG. 10C is a diagram showing a look-up table used for decoding in the decoder 74.

As shown in FIG. 10A, four states corresponding to control data of four kinds input to the decoder 71 are defined by control data (switch control signal) supplied from the decoder 71 to the address resonance power supply circuit 17. In the concrete, when the control data input to the decoder 71 is (0, 0), the decoder 71 outputs a state (SW1P, SW2P, SW3P)=(0, 0, 0) to turn off all switching elements S1P, S2P and S3P in the address resonance power supply circuit 17 (FIG. 5). When the control data input to the decoder 71 is (0, 1), the decoder 71 outputs a state (SW1P, SW2P, SW3P)=(1, 0, 0) to turn on the switching element S1P and turn off the switching elements S2P and S3P. When the control data input to the decoder 71 is (1, 0), the decoder 71 outputs a state (SW1P, SW2P, SW3P)=(1, 0, 1) to turn on the switching elements S1P and S3P and turn off the switching element S2P. When the control data input to the decoder 71 is (1, 1), the decoder 71 outputs a state (SW1P, SW2P, SW3P)=(0, 1, 0) to turn on the switching element S2P and turn off the switching elements S1P and S3P.

As for the combination of the states (on/off) of the switching elements S1P to S3P, $2^3=8$ combinations are conceivable. In the present embodiment, however, the states of the switching elements S1P to S3P are determined by referring to the look-up table. Therefore, combinations other than the above-described four combinations are inhibited. Therefore, occurrence of an abnormal combination in on/off states of the switching elements (for example, a state in which the switching element S1P and the switching element S3P are simultaneously in the off-state) can be prevented, and the role of a protection function can be played.

As shown in FIG. 10B, four states corresponding to control data of four kinds input to the decoder 72 are defined by control data (mode signal) supplied from the decoder 72 to the addressing driver 43. In the concrete, when the control data input to the decoder 72 is (0, 0), the decoder 72 outputs a state (1, 1, 0) to cause address data corresponding to one line supplied from the latch circuit 42 to be output from the addressing driver 43. When the control data input to the decoder 72 is (0, 1), the decoder 72 outputs a state (0, 0, 1) to make all switching elements in the addressing driver 43 open. When the control data input to the decoder 72 is (1, 0), the decoder 72 outputs a state (0, 0, 0) to cause all switching elements in the addressing driver 43 to have an output "H." When the control data input to the decoder 72 is (1, 1), the decoder 72 outputs a state (0, 1, 0) to make all switching elements in the addressing driver 43 to have an output "L."

As for the state combination for controlling the switching elements in the addressing driver 43, combinations other than the above-described four kinds are also conceivable. In the present embodiment, however, the states of the switching elements are determined by referring to the look-up table. Therefore, other combinations are inhibited.

As shown in FIG. 10C, four states corresponding to control data of five kinds input to the decoder 74 are defined by control data supplied from the decoder 74 to the drive control section 22. In the concrete, when the control data input to the decoder 74 is (0, 0, 0), the decoder 74 outputs a state (SW1, SW2, SW3, SW4)=(0, 0, 0, 0) to turn off all switching elements S1 to S4 in the sustaining driver 21 (FIG. 7). When the control data input to the decoder 74 is (0, 0, 1), the decoder 74 outputs a state (SW1, SW2, SW3, SW4)=(0, 0, 0, 1) to turn on the switching element S4 and turn off the switching elements S1 to S3. When the control data input to the decoder 74 is (0, 1, 0), the decoder 74 outputs a state (SW1, SW2, SW3, SW4)=(1, 0, 0, 0) to turn on the switching element S1 and turn off the switching element S2 to S4. When the control data input to the decoder 74 is (0, 1, 1), the decoder 74 outputs a state (SW1, SW2, SW3, SW4)=(1, 0, 1, 0) to turn on the switching element S1 and S3 and turn off the switching elements S2 and S4. When the control data input to the decoder 74 is (1, 0, 0), the decoder 74 outputs a state (SW1, SW2, SW3, SW4)=(0, 0, 0, 1) to turn on the switching element S4 and turn off the switching elements S1 to S3.

As for the combination of the states (on/off) of the switching elements S1 to S4, $2^4$=16 combinations are conceivable. In the present embodiment, however, the states of the switching elements S1 to S4 are determined by referring to the look-up table. Therefore, combinations other than the above-described four combinations are inhibited.

In the display panel driving apparatus 100 in the first embodiment, the encoded data are transferred and the data are decoded in the drive section 100B, as heretofore described. Unlike the case where data indicating on/off states of respective switching elements are transferred respectively, therefore, it is sufficient to represent only actually executed combinations of on/off states of switching elements, and consequently the amount of transferred data can be reduced. As a result, the number of transmission lines can be reduced. Furthermore, since output timing of data after decoding can be aligned, a skew occurrence can be suppressed efficiently. In addition, since data indicating an abnormal state can be prevented from being output in decoding, false operation due to noise mixed on the transmission line from the outside can be prevented.

Furthermore, in the panel drive apparatus 100 in the first embodiment, the shift clock is generated only during a period in which address data is being read. Therefore, the data in the shift register 41 is not updated during a period in which the address data is not being read, and data latched by noise after the latch enable becomes the same as the normal data. Even if address data is latched at false timing by noise, normal address data can be supplied to the plasma display panel 30. The latch enable generation section 16 generates the latch enable on the basis of the shift clock supplied to shift register 41. As a result, the generation timing of the latch enable can be certainly synchronized to the shift operation. In addition, since it is not necessary to separately generate a clock that prescribes timing for generating the latch enable and transmit the clock, the number of transmission lines can be reduced.

In the description of the first embodiment and Claims annexed hereto, the frame memory 1 corresponds to "storage section," and the read control section 3 corresponds to "read section." The control section 5 corresponds to "shift clock generation section," and the AND circuit 6 corresponds to "shift clock generation section." The decoder section 7 corresponds to "control signal conversion section," and the sustaining drivers 19 and 21 correspond to "drive pulse generation circuit." The scan driver 20 corresponds to "drive pulse generation circuit," and the reset pulse generation circuits 20A and 21A correspond to "drive pulse generation circuit." The drive control section 22 corresponds to "drive pulse generation circuit," and the plasma display panel 30 corresponds to "display panel." The addressing driver section 40 corresponds to "drive section" and "drive pulse generation circuit," and the addressing driver 43 corresponds to "driving circuit." The transmission lines L correspond to "data transfer device."

Second Embodiment

Figure 11:
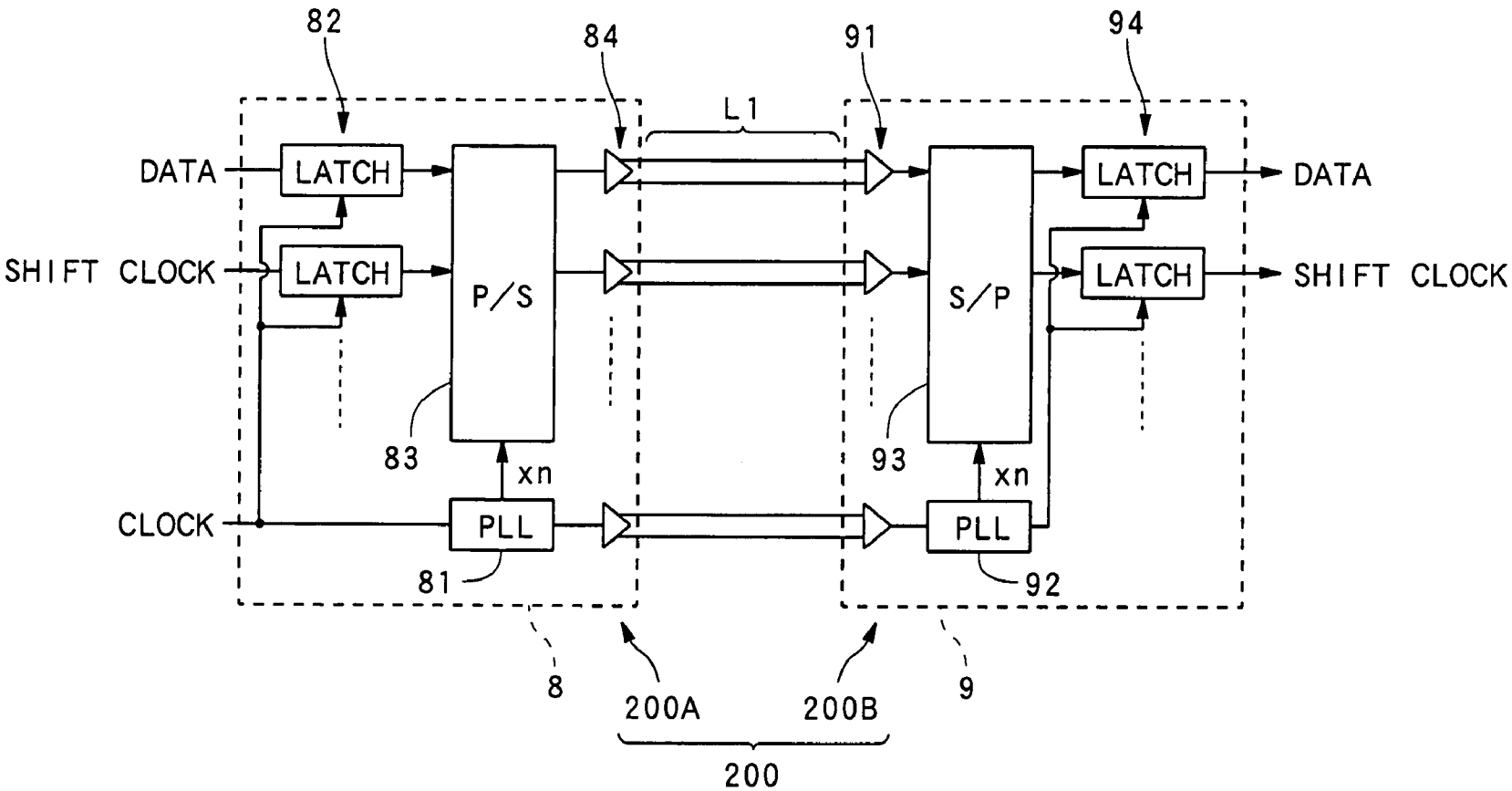
FIG. 11 is a diagram showing a configuration when LVDS system is used for the transmission.

Hereafter, a second embodiment of a display panel driving apparatus according to the present invention will be described with reference to FIG. 11. FIG. 11 is a block diagram showing a display panel driving apparatus in the present embodiment. In FIG. 11, only a part of a display panel driving apparatus 200 is shown. Hereafter, description of the same elements as those in the first embodiment will be omitted.

In the display panel driving apparatus 200 in the second embodiment, a system (differential serial transmission system) using LVDS (Low Voltage Differential Signaling) is used for transmission of the address data and the shift clock from a display control section 200A to a drive section 200B.

The transmission system using LVDS is a system that drives two signal lines symmetrically with opposite phases and transmits a difference between signals on the two signal lines. Therefore, the system has a feature that noises mixed from the outside can cancel each other out and the signal is not susceptible to the noises. As shown in FIG. 11, the display control section 200A in the display panel driving apparatus 200 includes a serializer 8 for converting multi-bit parallel data, such as the address data read from a frame memory 1, and a shift clock output from the AND circuit 6 (FIG. 1) to a series of serial differential signals. The drive section 200B includes a de-serializer 9 for re-converting a serial differential signal transferred from the serializer 8 via the transmission lines L1 to parallel data.

As shown in FIG. 11, the serializer 8 includes a PLL section 81 for receiving the clock from the control section 5 and generating a transmission clock, an input latch section 82 for latching address data read out from the frame memory 1, a shift clock output from the AND circuit 6, and pulse generation control data output from the control section 5 on the basis of the clock supplied from the control section 5, a parallel-to-serial conversion section 83 for serializing parallel data latched by the input latch section 82 on the basis of a clock that is supplied from the PLL section 81 and that is n times in frequency the clock supplied from the control section 5, and a transmission output section 84 for conducting differential serial transmission of serial data output from the parallel-to-serial conversion section 83, via the transmission line L1 formed of a twist cable or the like.

The address data and the shift clock input to the serializer 8 correspond to the address data and the shift clock (FIG. 1) output from the display control section 100A in the panel drive apparatus 100 in the first embodiment.

The de-serializer 9 includes a reception section 91 for receiving the differential serial signal transferred via the transmission line L1, a PLL section 92 for receiving a transfer clock transferred via the transmission line L1 and generating a clock, a serial-to-parallel conversion section 93 for converting a serial signal output from the reception section 91 to parallel data on the basis of a clock that is supplied from the PLL section 92 and that is n times in frequency the transfer clock, and an output latch section 94 for latching the parallel data output from the serial-to-parallel conversion section 93 on the basis of the clock supplied from the PLL section 92. The transfer clock and the clock supplied to the output latch section 94 have the same frequency as that of the clock input to the PLL section 81.

Address data shift operation and latch enable generation operation similar to those in the first embodiment are executed on the basis of the address data and the shift clock output from the output latch section 94.

In other words, the address data read out from the frame memory 1 are sequentially written into the shift register 41 (FIG. 1) from line to line, as shown in FIG. 4. At the time of rising up a shift clock for writing the final data (data z) corresponding to one line, a latch enable input to the latch circuit 42 (FIG. 1) rises. Therefore, the data corresponding to one line (for example, data "a" to data "z") are latched and simultaneously input to the addressing driver 43 (FIG. 1). As a result, at the time that a scan pulse is applied sequentially to the row electrodes Y1 to Yn in the addressing period, data pulses DP1 to DPn according to predetermined address data are applied to the column electrodes Z1 to Zm, in the same way as the first embodiment.

As regards the transmission and processing of various control data and clocks output from the control section 5 (FIG. 1), the display panel driving apparatus 200 in the second embodiment may also be formed in the same way as the display panel driving apparatus 100 in the first embodiment. Alternatively, these various control data and clocks may also be transmitted by using a serial transmission system.

In the display panel driving apparatus 200 in the second embodiment, the address data and the shift clock are converted to a series of serial data by the serializer 8, and transferred out. So to speak, the address data and the shift clock are simultaneously converted to data and both of them are transferred in a batch. Therefore, the number of transmission lines can be reduced, and a skew can be prevented from occurring between the address data and the shift clock. In addition, since the differential serial transmission system is adopted, mixture of noise on the transmission line L from the outside can be suppressed efficiently. Therefore, the false operation caused by noise can be suppressed efficiently.

Furthermore, in the display panel driving apparatus 200 in the second embodiment, the shift clock is generated only during a period in which address data is being read from the frame memory 1. Therefore, the data in the shift register 41 is not updated during a period in which the address data is not being read, and data latched by noise after the latch enable becomes the same as the normal data. Even if address data is latched at false timing by noise, normal address data can be supplied to the plasma display panel 30. The latch enable generation section 16 generates the latch enable on the basis of the shift clock supplied to shift register 41. As a result, the generation timing of the latch enable can be certainly synchronized to the shift operation. In addition, since it is not necessary to separately generate a clock that prescribes timing for generating the latch enable and transmit the clock, the number of transmission lines can be reduced.

In the description of the second embodiment and Claims annexed hereto, the parallel-to-serial conversion section 83 corresponds to "parallel-to-serial converter" and "data transfer device," and the transmission output section 84 corresponds to "transmission section" and "data transfer device." The serial-to-parallel conversion section 93 corresponds to "serial-to-parallel converter" and "data transfer device," and the transmission line L1 corresponds to "data transfer device."

In the above-described first and second embodiments, a plasma display panel is exemplified as the display panel. However, the present invention can be applied to various panels, such as liquid crystal display panels and EL display panels, as the display panels.

Further, it should be understood that various alternatives to the embodiments of the invention described herein may be employed in practicing the invention. Thus, it is intended that the following claims define the scope of the invention and that structures within the scope of these claims and their equivalents be covered thereby.

The entire disclosure of Japanese Patent Application No. 2003-40527 filed on Feb. 19, 2003 including the specification, claims, drawings and summary is incorporated herein by reference in its entirety.

What is claimed is:

1. A display panel driving apparatus comprising:

a display control section comprising a storage section for storing address data, a read section for reading address data stored in the storage section, and a shift clock generation section for generating a shift clock;

a drive section comprising a shift register for sequentially storing the address data according to the shift clock, a latch enable generation section for generating a latch enable, and a driving circuit for driving a display panel with the address data stored in the shift register on the basis of the latch enable; and a data transfer device for transferring data between the display control section and the drive section, wherein the shift clock generation section generates the shift clock only during a period in which address data is being read from the storage section, and the latch enable generation section generates the latch enable on the basis of the shift clock, and wherein the data transfer device comprises:

in the display control section, a parallel-to-serial converter for conducting parallel-to-serial conversion on the address data and the shift clock, and a transmission section for converting a serial signal resulting from parallel-to-serial conversion conducted in the parallel-to-serial converter to a signal conforming to a differential serial transmission system, and transferring a resultant signal toward the drive section via a transmission line; and in the drive section, a reception section for receiving the address data and the shift clock transferred via the transmission line, and a serial-to-parallel converter for conducting serial-to-parallel conversion on the address data and the shift clock received by the reception section.

* * * * *